US006701900B1

(12) United States Patent
Millar et al.

(10) Patent No.: US 6,701,900 B1
(45) Date of Patent: Mar. 9, 2004

(54) QUICK PRIMING FUEL SYSTEM AND COMMON PASSAGEWAY HOUSING FOR SAME

(75) Inventors: James S. Millar, Chillicothe, IL (US); Lloyd Thompson, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/379,062

(22) Filed: Mar. 4, 2003

Related U.S. Application Data

(63) Continuation of application No. 10/335,594, filed on Dec. 31, 2002, now abandoned.

(51) Int. Cl.[7] ..... F02M 37/04
(52) U.S. Cl. ..... 123/516; 123/461
(58) Field of Search ..... 123/461, 516, 123/179.9, 179.11, 179.17; 210/134, 340, 436

(56) References Cited

U.S. PATENT DOCUMENTS 3,815,746 A 6/1974 Ward
4,501,247 A * 2/1985 Gassler et al. ..... 123/453
4,617,116 A * 10/1986 Seiler ..... 210/137
5,327,872 A * 7/1994 Morikawa ..... 123/516
5,731,515 A * 3/1998 Tominaga et al. ..... 73/119 A
5,795,995 A * 8/1998 Shimaoka et al. ..... 73/40
6,021,763 A * 2/2000 Yoshihara et al. ..... 123/516

FOREIGN PATENT DOCUMENTS

SU 1359466 * 12/1987

* cited by examiner

*Primary Examiner*—Mahmoud Gimie
(74) *Attorney, Agent, or Firm*—Liell & McNeil

(57) ABSTRACT

In some fuel systems, such as those associated with a diesel engine, most if not all of the air that has leaked or been introduced into the fuel system must be evacuated before the fuel injectors can work properly to start the engine. Because such systems often utilize a pressure regulating valve to maintain the fuel system at some pressure, which is often substantially higher than atmospheric pressure, it can be difficult to evacuate air without first raising the air pressure in the fuel system above that which is required to open the pressure regulating valve. In addition, evacuating air from the fuel system can sometimes involve pushing the air through the fuel injectors in order to evacuate the same to the fuel tank. A quick priming fuel system includes air bleed passages that circumvent both the pressure regulating valve and the fuel injectors so that air can be quickly evacuated from the system at a relatively low pressure. These bleed bypass passageways are relatively restrictive to liquid flow so as not to undermine system pressure or otherwise undermine fuel supply to the fuel injectors.

20 Claims, 4 Drawing Sheets

28
50
51
52
53
40
30
54
24
55
44
10
41
32
49
33
22
42
26
56
48
35
43
34
14
12
12
35
32
31
20
16
30
18

QUICK PRIMING FUEL SYSTEM AND COMMON PASSAGEWAY HOUSING FOR SAME

RELATION TO OTHER PATENT APPLICATION

This is a continuation of application Ser. No. 10/335,594 filed Dec. 31, 2002 with the same title, now abandoned.

TECHNICAL FIELD

The present invention relates generally to fuel systems for internal combustion engines, and more particularly to fuel systems with features to encourage quick priming.

BACKGROUND

In one class of fuel systems, most or all of the fuel system needs to be primed before fuel injectors will operate properly to start an engine. The difficulty and time consumed in priming a fuel system can sometimes be harmful to the fuel system and/or engine components, and is usually annoying to an operator. Long priming times can sometimes create new situations in which damage can occur. For instance, when a fuel filter is changed, there are sometimes attempts to refill the filter before attaching the filter canister to its head assembly. Maintaining the filter canister full of fuel during attachment to a head assembly is difficult and may result in debris entering the filter opening. In addition, the new filter is sometimes filled with the contents of the old filter, which can also introduce contaminates into the clean side of the filter. This debris can potentially be pushed toward fuel injectors without being filtered.

Hand pumps are sometimes provided for priming an engine after servicing, such as after replacement of a fuel filter or fuel injector. Although these pumps can be effective, an operator does not always have the knowledge or the patience to pump a number of strokes necessary to properly prime the engine before attempting to start the same.

Diesel engines are typically hard to start if any vapor or air is entrained in the fuel system. After changing a fuel filter, it is typical for an operator to bleed the air out of the system by loosening some fittings (injectors or lines). This is almost always a messy and time consuming process, and often requires manual operation by a skilled mechanic. In many diesel systems, there are several potential parts that could fail and therefore leak air into the system causing hard or no start conditions. Among these might be fuel injector O rings, pressure regulating check valves, bypass check valves, hand priming fuel pumps, transfer fuel pumps, fuel fitting seals, other fittings and seals, etc. Problems associated with air in fuel lines has sometimes been approached in the past by an arguably excessive use of check valves intended to keep fuel in the system, and thereby keep air out. Unfortunately, this approach to the problem can sometimes cause system failure from air leaks. In addition, the system might also be sensitive to the check valve seal wearing out.

Over the years, engineers have incorporated various features in fuel systems in order to assist in priming the same. For instance, it is known to include a bypass passage around a pressure regulating valve in the hopes of hastening the time needed to evacuate air or vapor from a fuel system. This bypass passageway typically includes a flow restriction or orifice that allows gas to pass without restriction, but is relatively restrictive to liquid flow. This restriction to liquid flow serves to prevent the bypass passage from undermining system pressure. Another known strategy is to include a bypass passage that circumvents both the fuel injectors and the pressure regulating valve. In this known system, the bypass passageway is fluidly connected on the upstream side of the fuel system between the fuel filter and the fuel injectors and connected on the downstream side between the pressure regulating valve and the fuel tank. The bypass passage includes a hand manipulated valve that is only opened when the engine is off and being primed via a hand priming pump. The manual valve has an intentional leaking feature such that an operator can determine that the system is primed when fuel begins to squirt out of the leakage opening. Upon noticing this, the operator then closes the manual valve and cranks the engine to start in a conventional manner. In still another strategy, a bleed valve is positioned in a bypass passage around a pressure regulating valve. the bleed valve has a relatively low opening pressure threshold. The bypass passage also includes a flow restriction or orifice that passes gas without restriction but passes liquid with restriction, so as not to undermine the system pressure and the functioning of the pressure regulating valve. Although these systems have performed satisfactorily, there remains room for improvement.

The present invention is directed to real and/or perceived priming problems in fuel systems.

SUMMARY OF THE INVENTION

In one aspect, a fuel system includes a supply pump positioned between a fuel tank and at least one fuel injector. A pressure regulating valve is fluidly positioned between the fuel injector and the fuel tank. A first bypass passageway circumvents the fuel injector(s), and a second bypass passageway circumvents the pressure regulating valve.

In another aspect, a method of priming a fuel system includes a step of circumventing gas around at least one fuel injector via a first bypass passageway. Circumventing gas around a pressure regulating valve via a second bypass passageway.

In still another aspect, a common housing for a fuel system includes an adapter having a supply passage and a return passage disposed there through. A first bypass passageway is disposed in the adapter and fluidly connects the supply passage to the return passage. A second bypass passageway is disposed in the adapter and fluidly connects an upstream portion to a downstream portion of the return passage.

DETAILED DESCRIPTION

Figure 1:
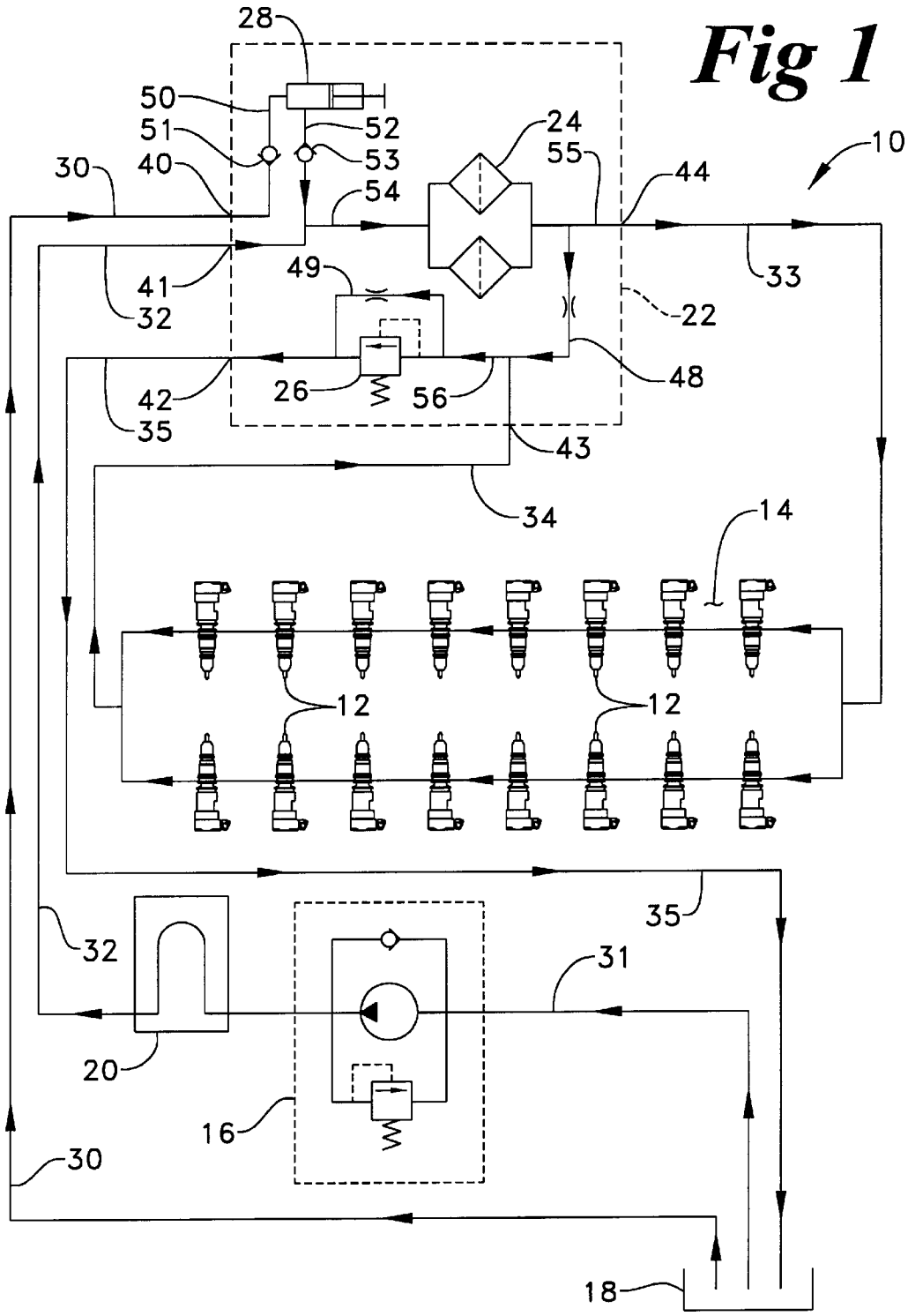
FIG. 1 is a schematic illustration of a fuel system according to an embodiment of the present invention.

Referring to FIG. 1, a fuel system 10 includes a supply pump 16 fluidly positioned between a fuel tank 18 and a plurality of fuel injectors 12. Fuel system 10 also includes a filter assembly 22 that includes filter(s) 24, a system pressure regulating valve 26 and an optional priming pump 28. Fuel system 10 also includes an electronic control module 20 that can control various aspects of the fuel system in a conventional manner, such as by controlling fuel injection timing and quantity. In the illustrated embodiment, fuel flows through the electronic control module 20 to cool the same. In the illustrated embodiment, fuel injectors 12 are mounted in an cylinder head 14 for direct injection into an engine cylinder for compression ignition operation. Nevertheless, those skilled in the art will appreciate that the present invention could be applied to fuel systems for any type of internal combustion engine.

Fuel is drawn by supply pump 16 from fuel tank 18 via pump supply passage 31. The outlet of supply pump 16 is connected to pump outlet passage 32, where it passes through filter assembly 22 into injector supply passage 33. After flowing through injectors 12, fuel passes back to filter assembly 22 via return passage 34. After passing pressure regulating valve 26, the fuel enters drain passage 35 for eventual return to fuel tank 18. A separate priming supply passage 30 is connected to fuel tank 18 upstream from supply pump 16, and connected to injector supply passage 33 via a separate fluid circuit. Although not necessary, the present invention preferably arranges the filter assembly 22 to be a fluid crossroads for both fuel being supplied to fuel injectors 12 and fuel returning to tank 18 from the same.

Figure 2:
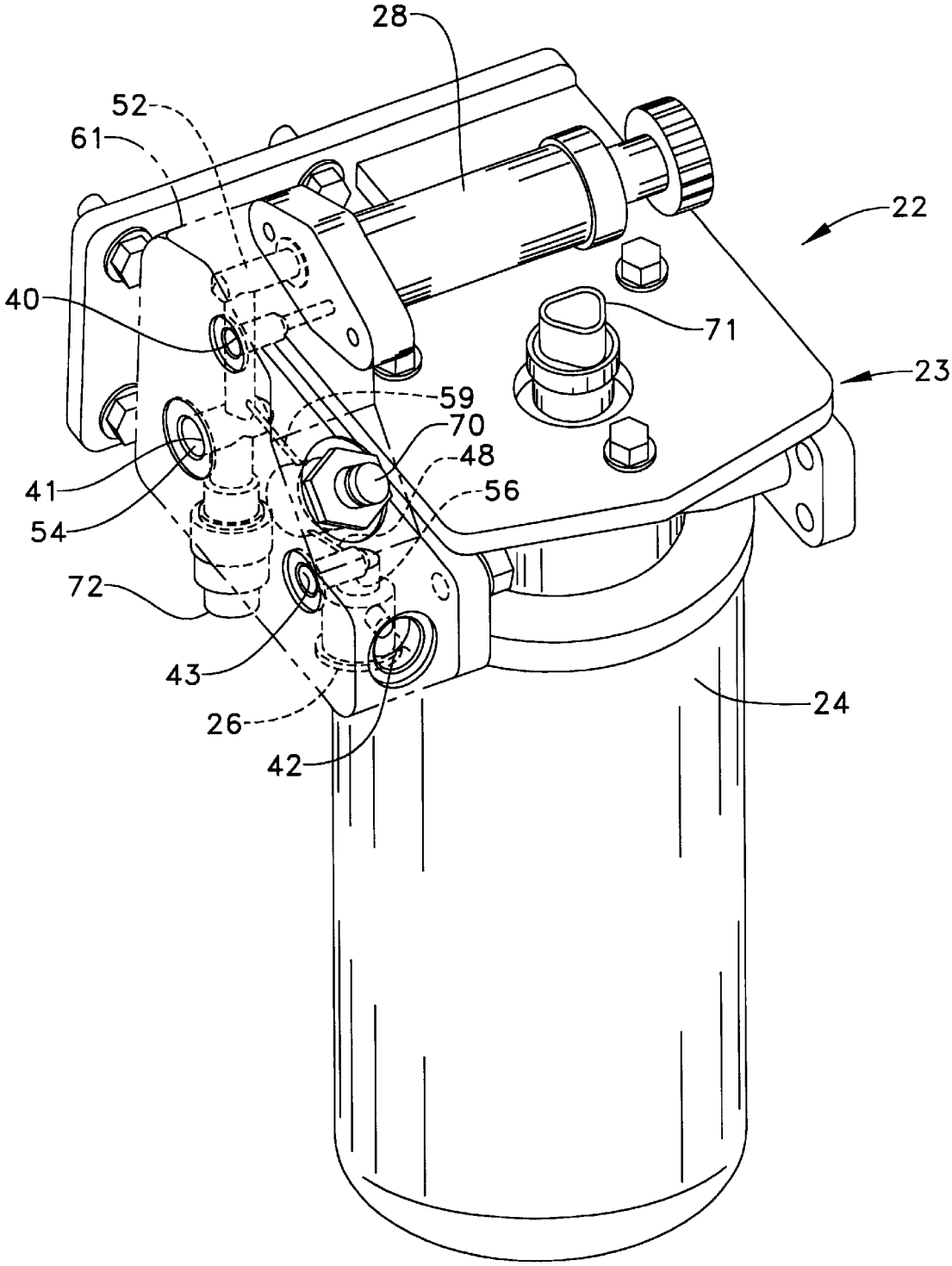
FIG. 2 is a partial isometric view of a filter assembly according to another aspect of the present invention.
Figure 3:
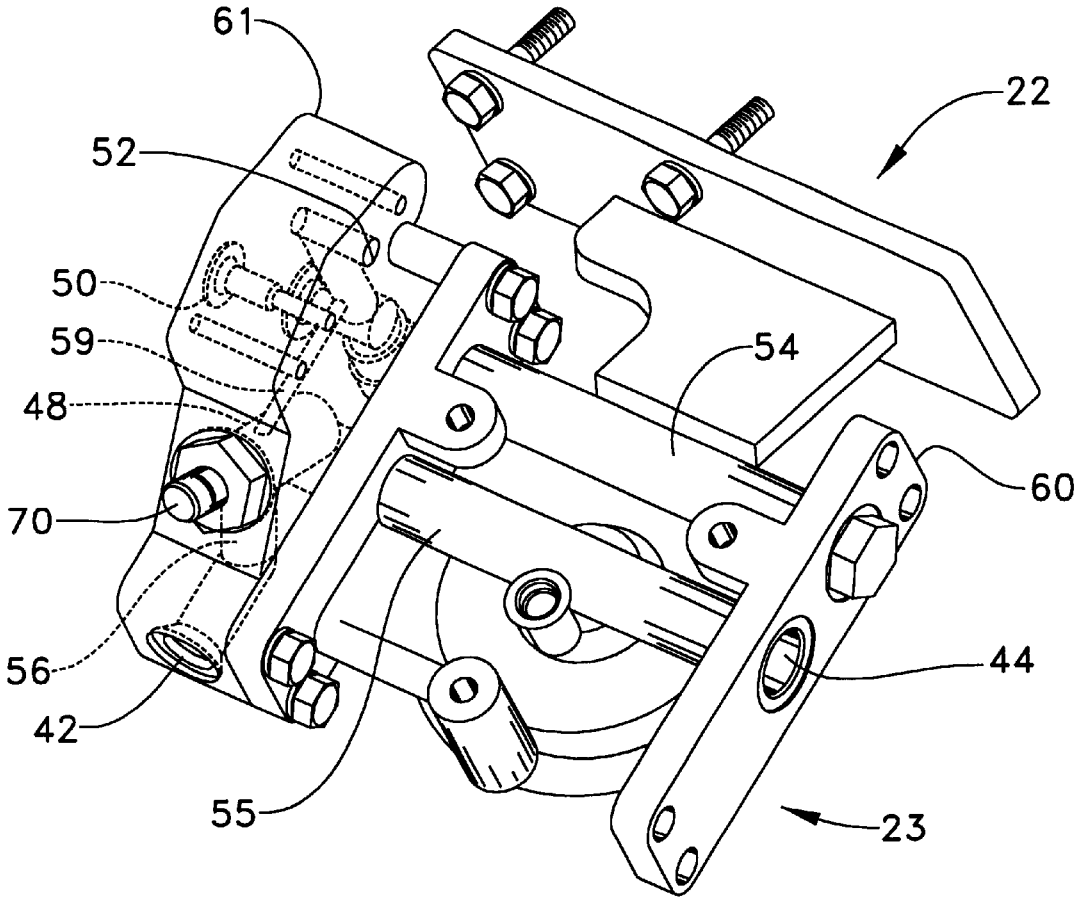
FIG. 3 is an isometric view from a different perspective the filter head assembly of FIG. 2.
Figure 4:
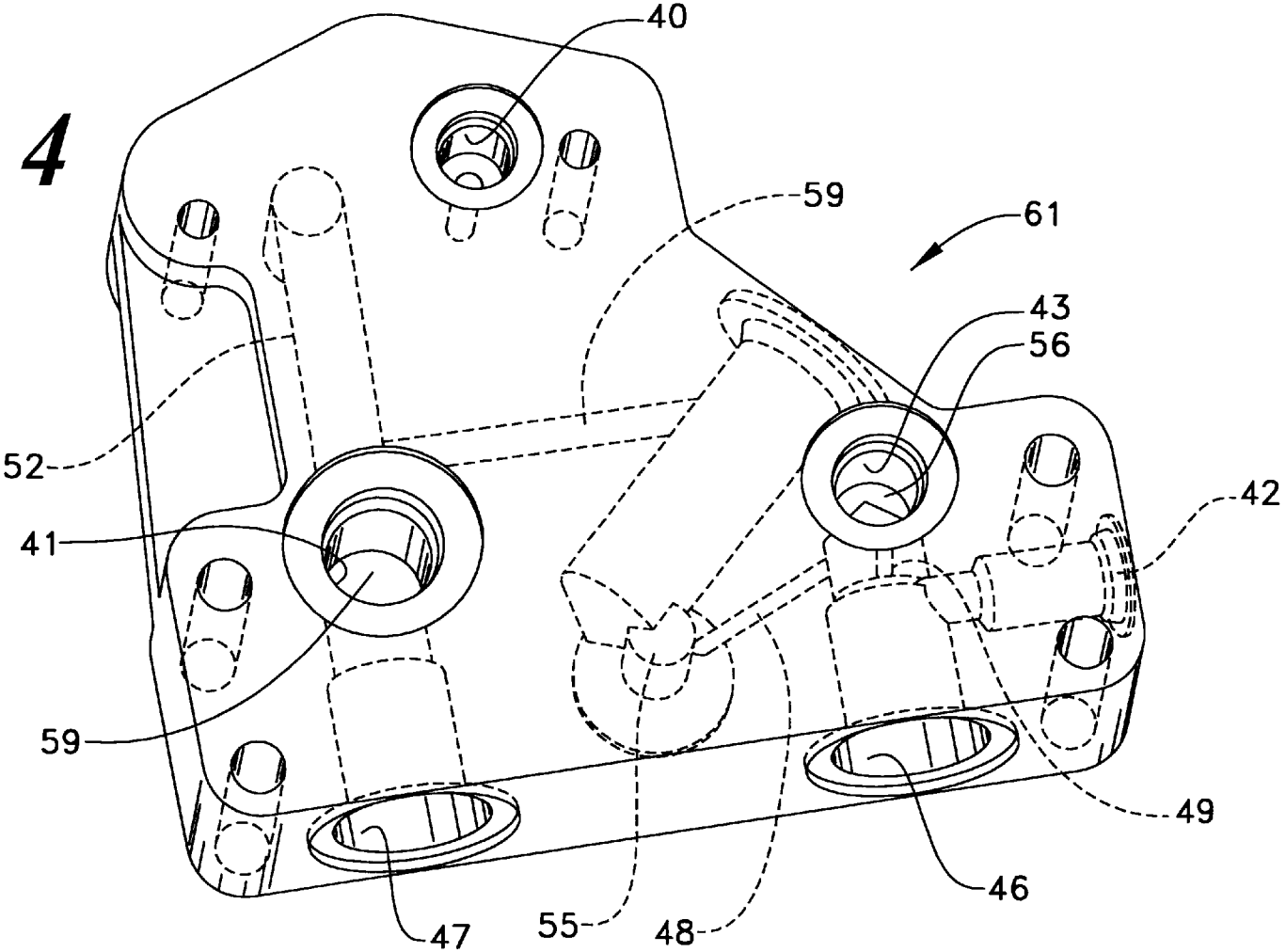
FIG. 4 is an isometric view of an adapter for the filter head assembly of FIG. 3.

Referring in addition in FIGS. 2 and 3, filter assembly 22 includes a filter head assembly 23 attached to at least one fuel filter 24. Filter head assembly 23 acts as a common housing for various components and passageways. For instance, a pressure differential sensor 70, an absolute pressure sensor 71 and a temperature sensor 72 are all mounted to filter head assembly 23. In addition to various components attached to filter head assembly 23, it also includes various internal passageways and includes five ports attached to various other passageways of fuel system 10. Referring in addition to FIG. 4, four of these ports can be located in an adapter 61, and a filter outlet port 44 can be located in a separate portion of filter head assembly 23. Filter head assembly 23 and adapter 61 include a priming inlet port 40 fluidly connected to the priming supply passage 30, a filter inlet port 41 fluidly connected to pump outlet passage 32, and an injector return port 43 fluidly connected to return passage 34. In addition, filter head assembly 23 includes a tank return port 42 fluidly connected to drain passage 35, and a filter outlet port 44 fluidly connected to injector supply passage 33.

Priming pump 28 is illustrated as a hand priming pump that is optional. However, those skilled in the art will appreciate that another priming pump, such as electronically operated priming pump could be substituted in place of hand priming pump 28. In other systems, a priming pump 28 can be excluded all together. In the illustrated embodiment, priming pump 28 operates by drawing fluid in through priming inlet port 40 into an internal priming inlet 50 past a check valve 51. Fluid leaving priming pump 28 passes through an internal priming outlet 52 past a check valve 53 into a filter supply passage 54, which is directly connected to filter inlet port 41. Fluid in filter supply passage 54 is filtered in filter(s) 24 and then passes into filter outlet passage 55 before leaving filter assembly 22 via filter outlet port 44. Priming pump 28 fluidly circumvents supply pump 16 by being directly connected to tank 18.

A first bypass passage 48 is defined by adapter 61, and fluidly connects the injector supply passage 33 to return passage 34 at internal return passage 56. Fluid in internal return passage 56 passes to drain passage 35 either through pressure regulating valve 26 or around the same via second bypass passageway 49. Thus, first bypass passageway 48 can be thought of as circumventing the fuel injectors 12, while second bypass passageway 49 can be thought of as fluidly connecting an upstream portion to a downstream portion of the drain/return passage to circumvent pressure regulating valve 26.

First bypass passageway 48 is preferably located above the fuel injectors 12 so that any air introduced into the system, such as by changing a filter 24 can be quickly passed into return passage 56 without having to be pushed through fuel injectors 12. Although first bypass passageway 48 has its end connected upstream from pressure regulating valve 26, those skilled in the art will appreciate that the downstream end of first bypass passageway 48 could be connected directly to drain passage 35 anywhere downstream of pressure regulating valve 26, including a possible connection directly into second bypass passageway 49. First bypass passageway 48 preferably has a relatively small flow area so that gases, including air and/or vapor, are easily passed therethrough, but is relatively restrictive to liquid fuel flow so that the normal supply of fuel at a proper pressure to fuel injectors 12 via injector supply passage 33 is not substantially undermined. Those skilled in the art will recognize that the flow area restriction can be accomplished by positioning a flow restriction orifice of a suitable diameter in the passageway, as shown in the schematic. In other words, bypass passageway 48 should be sized for reduced liquid flow, to avoid fuel from bypassing the fuel injectors. First bypass passageway 48 is also preferably arranged to create a siphon break with respect to fuel located in cylinder head 14. Nevertheless, those skilled in the art will recognize that the same principals can be applied to systems with fuel rails separated from the cylinder head. This is preferably accomplished by locating first bypass passageway 48 at a location elevationally above the inlet ports to cylinder head 14, as shown in FIG. 1. This helps enable fuel to remain in cylinder head 14 (common rail) at all times to further hasten priming and engine start up.

Second bypass passage 49 preferably has a relatively small flow area that is sufficiently large to allow for quick free flow of air and/or vapor, but relatively restrictive to liquid fuel flow so as to not undermine system pressure via an undermining of the functioning of pressure regulating valve 26. This can be accomplished by incorporating a flow restriction orifice into the passageway, as shown in the schematic. Second bypass passageway 49 helps to evacuate gases from system 10 without forcing the fuel lines to a pressure that will open pressure regulating valve 26. Together, bypass passageways 48 and 49 are portions of a bypass flow path that allows gas, which may originate in the area of filter 24 due to a filter change, to circumvent both of the fuel injectors 12 and pressure regulating valve 26 during engine priming and start up. In other words, air can be evacuated from system 10 at a relatively low pressure. Bypass passageway 49 may be incorporated into the valve member for regulating valve 26.

Referring now to FIG. 4, both first bypass passageway 48 and second bypass passageway 49 are preferably defined by an adapter 61 that is a portion of filter head assembly 23. Adaptor 61 can be made from any suitable material but is preferably cast and machined to include the various passageways and fastener pores illustrated in FIG. 4. Among these are a cavity 47 for receiving the temperature sensor 72, and a cavity 46 for receiving pressure regulating valve 26. In addition, adapter 61 defines a pressure sensor passage 59 that allows pressure differential sensor 70 (FIGS. 2 and 3) to sense the pressure differential across the cylinder head 14.

INDUSTRIAL APPLICABILITY

When in operation, system 10 can be primed in at least one of two ways. First, priming pump 28 can be operated to push any air in filters 24 back to tank via a bypass flowpath that includes first bypass passageway 48, internal return passage 56 and second bypass passageway 49. It is likely that an operator using hand pump 28 would be able to quickly detect, via the back pressure feel when the system was primed. In addition, this priming should not take very much effort as priming pump 28 need not pump fluid through supply pump 16, and most often need not push air and/or fuel through fuel injectors 12. Alternatively, the system can be primed by cranking the engine to start supply pump 16, which is preferably a gear driven pump directly coupled to the engine. Because the air can be evacuated at a relatively low pressure, substantially shorter cranking times should be required in order to evacuate any air from system 10 back to tank 18 in order to start the engine. In addition, there is preferably enough fuel remaining in cylinder head 14 to start the engine. In fact, there is preferably enough fuel in one of the cylinder heads to enable the engine to start with only half of its injectors operating if an injector in the other head is replaced due to servicing or another reason rendering that head in need of being primed.

By channeling both supply flow and return flow through the filter head assembly, the bypass passageways of the present invention can be added simply via small cross drilled bores in an adapter through which both supply and return passages pass. This strategy should allow the quick priming features of the present invention to be easily implemented in a way that renders the fuel system more easily serviced in the future. Although the bypass passageways are shown in the illustrated embodiment as being unobstructed, in some applications it might be desirable to include a check valve or a spring loaded check valve. However, the pre-load on the check valves should be preferably relatively low in order to allow them to open and allow air to be evacuated from the system at a relatively low pressure.

It should be understood that the above description is intended for illustrative purposes only, and is not intended to limit the scope of the present invention in any way. Thus, those skilled in the art will appreciate that other aspects of the invention can be obtained from a study of the drawings, the disclosure and the appended claims.

What is claimed is:

1. A fuel system comprising:

a fuel tank;

a least one fuel injector;

a supply pump fluidly positioned between said fuel tank and said at least one fuel injector;

a fuel return passage with an upstream end fluidly connected to said at to said at least one fuel injector;

a fuel filter fluidly positioned between said supply pump and said at least one fuel injector;

a pressure regulating valve fluidly positioned between said at least one fuel injector and said fuel tank; and a bypass flowpath that circumvents said at least one fuel injector and said pressure regulating valve, and passing gas flow without restriction, but passing liquid flow with restriction.

2. The fuel system of claim 1 wherein said bypass flowpath is unobstructed.

3. A fuel system comprising:

a fuel tank;

a least one fuel injector;

a supply pump fluidly positioned between said fuel tank and said at least one fuel injector;

fuel filter fluidly positioned between said supply pump and said at least one fuel injector;

a pressure regulating valve fluidly positioned between said at least one fuel injector and said fuel tank;

a bypass flowpath that circumvents said at least one fuel injector and said pressure regulating valve, and passing gas flow without restriction, but passing liquid flow with restriction;

said bypass flowpath includes a first bypass passageway that circumvents said at least one fuel injector; and said bypass flowpath includes a second bypass passageway circumventing said pressure regulating valve.

4. The fuel system of claim 3 wherein said first and second bypass passageways are disposed a common housing.

5. The fuel system of claim 4 wherein said common housing is a portion of a filter head assembly.

6. The fuel system of claim 5 wherein an inlet to said first bypass passageway is located elevationally above said filter.

7. The fuel system of claim 3 including a priming passage circumventing said supply pump; and a priming pump positioned in said priming passage.

8. The fuel system of claim 3 wherein said first bypass passageway is a siphon brake with respect to fuel adjacent said at least one fuel injector.

9. The fuel system of claim 8 wherein said fuel adjacent said at least one fuel injector is located in a cylinder head.

10. The fuel system of claim 3 wherein said first bypass passageway positioned elevationally above an inlet to said at least one fuel injector.

11. The fuel system of claim 3 wherein an inlet to said first bypass passageway is located elevationally above an outlet from said filter.

12. A method of priming a fuel system, comprising the steps of:

pumping liquid fuel from a tank toward at least one fuel injector at least in part with a supply pump;

circumventing gas at a low pressure around the at least one fuel injector and a pressure regulating valve to the tank via an unobstructed bypass flowpath; and increasing liquid fuel pressure in the fuel system to a high pressure with the supply pump.

13. A method of priming a fuel system, comprising the steps of:

pumping liquid fuel from a tank toward at least one fuel injector at least in part with a supply pump;

circumventing gas at a low pressure around the at least one fuel injector and a pressure regulating valve to the tank via a bypass flowpath; and increasing liquid fuel pressure in the fuel system to a high pressure with the supply pump;

said pumping step includes the steps of pumping liquid from the tank toward the at least one fuel injector with a priming pump; and then pumping liquid from the tank toward the at least one fuel injector with the supply pump.

14. The method of claim 13 including a step of introducing gas into the fuel system before the pumping step at least in part by replacing at least one of a fuel filter and a fuel injector.

15. The method of claim 14 including a step of starting an engine;

restricting flow of liquid fuel through the bypass flowpath after the starting step.

16. The method of claim 15 wherein the circumventing step is performed within a fuel filter assembly.

17. The method of claim 16 wherein the step of pumping liquid fuel with a priming pump includes a step of circumventing the supply pump.

18. The method of claim 17 including a step of maintaining the pressure regulating valve in a closed position during the circumventing steps; and maintaining the bypass flowpath open after the starting step.

19. A common housing for a fuel system comprising;

adapter having a supply passage and a return passage disposed there through;

a first bypass passageway disposed in said adapter and fluidly connecting said supply passage to said return passage; and a second bypass passageway that is unobstructed, is disposed in said adapter and fluidly connecting an upstream portion to a downstream portion of said return passage.

20. The common housing of claim 19 wherein said adapter is a portion of a filter assembly.

* * * * *